US009297576B2

(12) United States Patent
Alt et al.

(10) Patent No.: US 9,297,576 B2
(45) Date of Patent: Mar. 29, 2016

(54) REFRIGERATION APPLIANCE COMPRISING A STORAGE COMPARTMENT THAT CAN BE OFFSET

(71) Applicant: BSH HAUSGERÄTE GMBH, München (DE)

(72) Inventors: René Alt, München (DE); Christoph Becke, Grosskarolinenfeld (DE); Herbert Cizik, Ottenbach (DE); Max Eicher, München (DE); Christine Hartwein, München (DE); Philipp Kleinlein, München (DE); Ralph Staud, München (DE); Thomas Tischer, Haar (DE); Cetin Abdullah Celik, Cerkezköy (TR); Jürgen Fink, Gerstetten (DE); Holger Freytag-Schönwalde, Ottobrunn (DE)

(73) Assignee: BSH Hausgeräte GmbH, München (DE)

( * ) Notice: Subject to any disclaimer, the term of this patent is extended or adjusted under 35 U.S.C. 154(b) by 0 days.

(21) Appl. No.: 14/772,860

(22) PCT Filed: Mar. 4, 2014

(86) PCT No.: PCT/EP2014/054126

§ 371 (c)(1),
(2) Date: Sep. 4, 2015

(87) PCT Pub. No.: WO2014/135516

PCT Pub. Date: Sep. 12, 2014

(65) Prior Publication Data

US 2016/0054051 A1 Feb. 25, 2016

(30) Foreign Application Priority Data

Mar. 5, 2013 (DE) ..... 10 2013 203 723

(51) Int. Cl.
*A47B 96/04* (2006.01)
*F25D 25/02* (2006.01)

(52) U.S. Cl.
CPC ..... *F25D 25/021* (2013.01); *F25D 25/025* (2013.01)

(58) Field of Classification Search
CPC ..... F25D 25/021; F25D 25/025
USPC ..... 312/404
See application file for complete search history.

(56) References Cited

U.S. PATENT DOCUMENTS 2,064,096 A 12/1936 Whalen
5,918,959 A * 7/1999 Lee ..... F25D 25/025 312/330.1

(Continued)

FOREIGN PATENT DOCUMENTS

| | | |
|---|---|---|
| DE | 10 2007 060834 | 6/2009 |
| DE | 10 2010 043422 | 5/2012 |
| EP | 0 498 485 | 8/1992 |

OTHER PUBLICATIONS

International Search Report for PCT/EP2014/054126 mailed Sep. 4, 2014, three pages.

(Continued)

*Primary Examiner* — Hanh V Tran
(74) *Attorney, Agent, or Firm* — Nixon & Vanderhye P.C.

(57) ABSTRACT

A refrigeration appliance includes a refrigeration compartment, in which a storage container for refrigerated goods is mounted on a pull-out panel such that it can be displaced between an inserted position and a pulled-out position. The container can be arranged in a first position and a second position on the pull-out panel, the first position and the second position differing along the direction of the width of the refrigeration appliance.

11 Claims, 5 Drawing Sheets

(56) References Cited

U.S. PATENT DOCUMENTS

2007/0035221 A1* 2/2007 Koo ..... F25D 25/025 312/404
2008/0265733 A1* 10/2008 Hue ..... F25D 25/025 312/404
2009/0173100 A1* 7/2009 Kang ..... F25D 25/025 62/407
2010/0162745 A1* 7/2010 Kim ..... F25D 25/025 62/407
2011/0241515 A1* 10/2011 Park ..... A47B 88/10 312/408
2012/0024006 A1* 2/2012 Knoll ..... A47B 96/02 62/465
2012/0325827 A1* 12/2012 Hauser ..... F25D 25/025 220/592.02

OTHER PUBLICATIONS

Written Opinion for PCT/EP2014/054126 mailed Sep. 4, 2014, seven pages.

* cited by examiner

REFRIGERATION APPLIANCE COMPRISING A STORAGE COMPARTMENT THAT CAN BE OFFSET

This application is the U.S. national phase of International Application No. PCT/EP2014/054126 filed 4 Mar. 2014 which designated the U.S. and claims priority to DE Patent Application No. 10 2013 203 723.6 filed 5 Mar. 2013, the entire contents of each of which are hereby incorporated by reference.

The invention relates to a refrigeration appliance comprising a refrigeration compartment in which a storage compartment for refrigerated goods is mounted on a pull-out panel such that it can be displaced between an inserted position and a pulled-out position.

Refrigeration appliances, in particular refrigeration appliances configured as domestic appliances, are known and are used for household management in the home or in the catering field in order to store perishable foodstuffs and/or beverages at specific temperatures.

Such refrigeration appliances have the possibility of changing the door stop, i.e. depending on the location or installed situation of the refrigeration appliance, the opening direction of a refrigeration appliance door may be adapted by converting a door hinge. In this case, with a door opening angle of a minimum of 90° it is intended to be possible to pull out a storage compartment mounted on the pull-out panel, as far as a door post of the refrigeration appliance door. In order to ensure this, on both sides a certain minimal spacing has to be maintained between the storage compartment and a collision edge of the refrigeration appliance door. This results in unused volume for the refrigerated goods in the refrigeration compartment.

A refrigeration appliance of this type is disclosed by DE 10 2007 060 834 A1.

Furthermore U.S. Pat. No. 2,064,096 discloses a shelf support and EP 0 498 485 A2 discloses a refrigeration appliance.

It is, therefore, the object of the invention to provide a refrigeration appliance with increased volume for the refrigerated goods.

This object is achieved by the subjects according to the independent claims. Advantageous developments form the subject of the dependent claims, the description and the drawings.

The present invention is based on the recognition that the volume for the refrigerated goods may be increased if the storage compartment is able to be offset on the pull-out panel.

According to a first feature, the object according to the invention is achieved by a refrigeration appliance in which the storage compartment can be arranged in a first position and in a second position on the pull-out panel, wherein the first position and the second position differ in the direction of the width of the refrigeration appliance. As a result, the technical advantage is achieved that a minimum spacing from the collision edge does not have to be maintained on both sides of the storage compartment but only on one side of the storage compartment. Therefore, the volume for the refrigerated goods is increased.

A "refrigeration appliance" is understood, in particular, as a domestic appliance, i.e. a refrigeration appliance which is used for household management in the home or in the catering field and, in particular, serves to store foodstuffs and/or beverages at specific temperatures, such as for example a refrigerator, an upright freezer, a combined fridge-freezer, a chest freezer or a wine cooler.

A spacer is able to be arranged at a first point or at a second point on the pull-out panel, wherein with a spacer at the first point the compartment is in the first position and with a spacer at the second point the compartment is in the second position. As a result, the technical advantage is achieved that the position of the storage compartment on the pull-out panel is able to be fixed by the spacer in a simple manner. Thus neither the storage compartment nor the pull-out panel has to be structurally altered, which simplifies production.

The spacer is fastened to the pull-out panel. This achieves the technical advantage that the spacer is not noticeable in a disruptive manner if, for example, a storage compartment is removed from the refrigerator compartment.

In a further advantageous embodiment, the spacer has a contact surface for the storage compartment. As a result, the technical advantage is achieved that by means of the contact surface the spacer fixes the position of the storage compartment on the pull-out panel. Thus, the spacer may be configured to be small and takes up little constructional space.

In a further advantageous embodiment, the spacer is fastened to the pull-out panel. As a result, the technical advantage is achieved that the spacer is not noticeable if, for example, a storage compartment is removed from the refrigeration compartment.

In a further advantageous embodiment, the spacer is fastened to the pull-out panel by means of a latching connection. As a result, the technical advantage is achieved that the spacer may be fastened without additional connecting means, such as for example screws or bolts.

In a further advantageous embodiment, the spacer has a latching hook for forming the latching connection. As a result, the technical advantage is achieved that the spacer comprising the latching hook has a particularly simple construction.

In a further advantageous embodiment, the latching hook has a latching lug. As a result, the technical advantage is achieved that the latching connection is additionally secured by an engagement of the latching lug in a recess of the pull-out panel.

In a further advantageous embodiment, the latching connection is configured to be releasable without the use of tools. As a result, the technical advantage is achieved that a displacement of the position of the spacer is possible without the aid of tools. To this end, for example the latching connection may be configured such that it is automatically released when a minimum force is exceeded.

In a further advantageous embodiment, a spacer is able to be moved into a first state or into a second state, wherein with a spacer in the first state the storage compartment is in the first position and with a spacer in the second state the storage compartment is in the second position. As a result, the technical advantage is achieved that the spacer may be fastened to the pull-out panel and thus is not able to be mislaid, but clearly fixes the position of the storage compartment.

In a further advantageous embodiment, the spacer has a first portion and a second portion, wherein the first portion is connected in an articulated manner to the second portion. As a result, the technical advantage is achieved that by a simple movement, for example a folding movement, the spacer is able to be brought from the first state into the second state. Thus the two portions do not have to be mounted and dismantled again in order to carry out a change from the first to the second state and vice versa.

In a further advantageous embodiment, the first portion and the second portion of the spacer are connected together by a film hinge. As a result, the technical advantage is achieved that the spacer may be configured integrally with the first portion and the second portion and thus have a particularly simple construction.

In a further advantageous embodiment, the pull-out panel has at least two compartment holders arranged offset in the direction of the width of the refrigeration appliance. As a result, the technical advantage is achieved that by offsetting the storage compartment from the first compartment holder into the second compartment holder, an adaptation to the selected door stop may be undertaken.

In a further advantageous embodiment, a third compartment holder is provided. As a result, the technical advantage is achieved that additionally a third, central position is provided in which the storage compartment may be used symmetrically with the same spacing on both sides, or alternatively a larger storage compartment may be used. This applies, in particular, if the door is able to be opened wide beyond 90°.

According to a second feature, the object according to the invention is achieved by a pull-out panel for such a refrigeration appliance. As a result, the technical advantage is achieved that a minimum spacing from the collision edge does not have to be maintained on both sides of the storage compartment but only on one side of the storage compartment. Therefore, the volume for the refrigerated goods is increased.

According to a third feature, the object according to the invention is achieved by a spacer for such a refrigeration appliance. As a result, the technical advantage is achieved that a minimum spacing from the collision edge does not have to be maintained on both sides of the storage compartment but only on one side of the storage compartment. Therefore, the volume for the refrigerated goods is increased.

Further exemplary embodiments are described with reference to the accompanying drawings, in which:

FIG. 1 shows a refrigerator as an exemplary embodiment for a refrigeration appliance 100 with a refrigerator door 102 on the front face of the refrigeration appliance. The refrigerator serves, for example, for cooling foodstuffs and comprises a coolant circuit with an evaporator (not shown), a compressor (not shown), a condenser (not shown) and a throttle member (not shown).

The evaporator is configured as a heat exchanger, in that after expansion the liquid coolant is evaporated by the absorption of heat from the medium to be cooled, i.e. air, in the interior of the refrigerator.

The compressor is a mechanically driven component which draws in coolant vapor from the evaporator and discharges it to the condenser at a higher pressure.

The condenser is configured as a heat exchanger in which after compression the evaporated coolant is condensed by the output of heat to an external cooling medium, i.e. the surrounding air.

The throttle member is a device for the continuous reduction of pressure by reducing the cross section.

The coolant is a fluid which is used for the transmission of heat in the cold-generating system and which at low temperatures and low pressure of the fluid absorbs heat and at a higher temperature and higher pressure of the fluid discharges heat, wherein it is generally implicit that the state of the fluid is altered.

By means of the refrigeration appliance door 102 a refrigeration compartment 104 may be opened, said refrigeration compartment in the present exemplary embodiment being configured as a cooling compartment.

Figure 1:
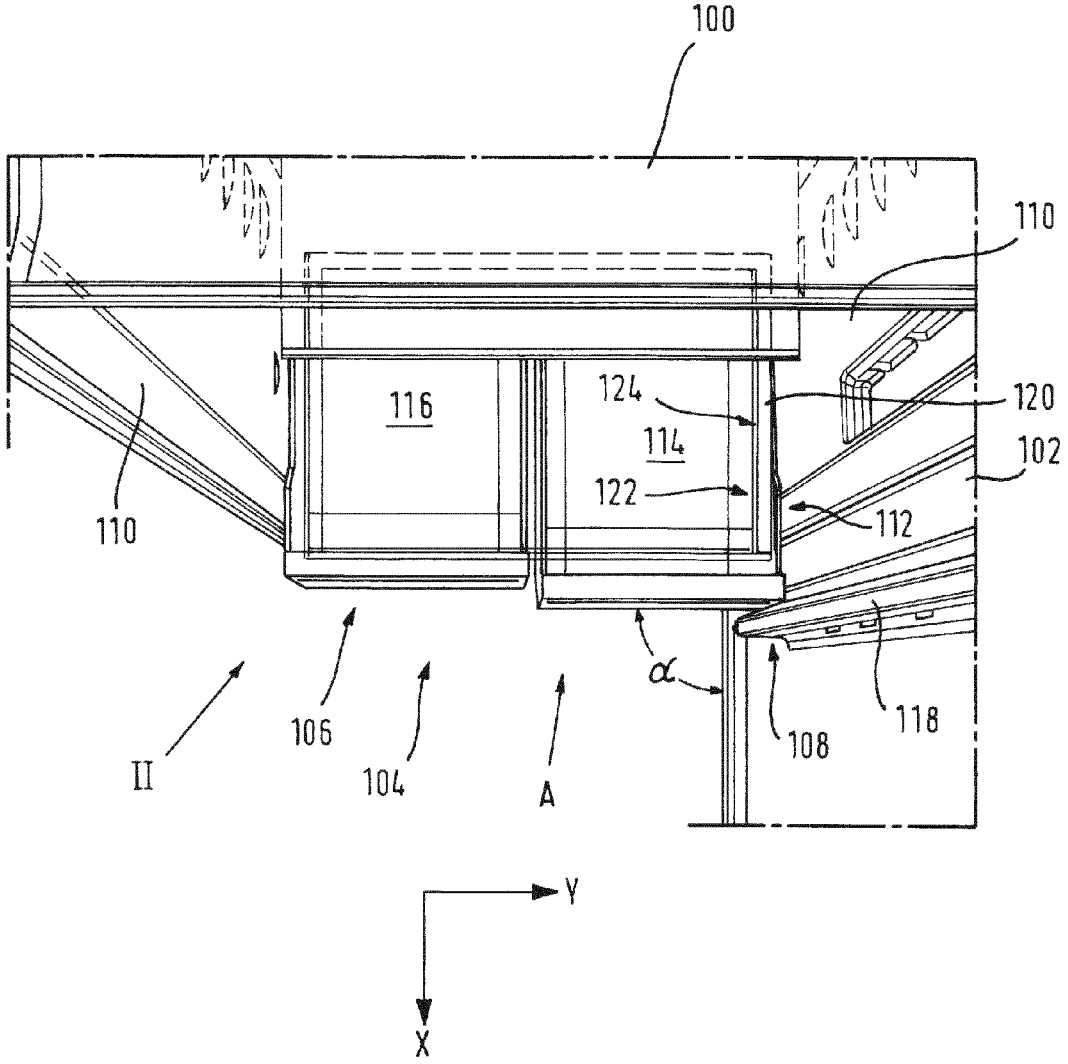
FIG. 1 shows a perspective view of a refrigeration appliance.

In the refrigeration compartment 104 a pull-out panel 106 is arranged such that it can be displaced between an inserted position I and a pulled-out position II (see FIG. 1). Such a pull-out panel 106 is also denoted as a tray. On the pull-out panel 106, in the present exemplary embodiment two storage compartments 114, 116 are placed on the pull-out panel 106. In the present exemplary embodiment, both storage compartments 114, 116 are configured as storage compartments for fish and/or meat at a temperature of ca. 1° Celsius. Such storage compartments are also denoted as chiller boxes.

FIG. 1 shows that the refrigeration appliance door 102 has been pivoted by a door opening angle $\alpha$ of 90° in the present exemplary embodiment, in order to open the refrigeration compartment 104. In this position, the refrigeration appliance door 102 forms a collision edge 108 for the drawer 106. So that the pull-out panel 106 when displaced from the inserted position I (see FIG. 2) into the pulled-out position II does not strike against the collision edge 108, in the present exemplary embodiment the storage compartment 114 is arranged spaced apart by a spacing 112 from a side wall 110 which defines the refrigeration compartment 104 of the refrigeration appliance 100. To this end the storage compartment 114 has been arranged in a first position A on the pull-out panel 106 in the refrigeration compartment 104 of the refrigeration appliance 100.

Moreover, FIG. 1 shows that, due to the spacing 112, the pull-out panel 106 passes a collision edge 108 when it is displaced into the pulled-out position II. Thus, in the present exemplary embodiment, with a door opening angle $\alpha$ of 90° it is possible to pull the pull-out panel 106 with the positioned storage compartments 114, 116 as far as a door post 118 of the refrigeration appliance door 102.

In the present exemplary embodiment, the refrigeration appliance 100 is configured such that the refrigeration appliance door 102, as shown in FIG. 1, may be arranged on the right-hand side or alternatively on the left-hand side. Thus it is possible to change a door stop of the refrigeration appliance door 102.

A spacer 120 is arranged on the right-hand side of the pull-out panel 106. The spacer 120 in the present exemplary embodiment is connected by means of a latching connection 122 to the pull-out panel 106 and may be dismantled without the use of tools. In the present exemplary embodiment, the latching connection 122 is configured such that when a minimum force is exceeded it is automatically released.

The spacer 106 in FIG. 1 is arranged between the side wall 110 and the storage compartment 114 and is fixed such that the storage compartment 114 is located in the first position A.

In the present exemplary embodiment, the spacer 120 has a contact surface 124 which is in contact with the storage compartment 114 and ensures that the pull-out panel 106 remains in the first position A, both in the inserted position I and in the pulled-out position II. Thus the pull-out panel 106 with the storage compartments 114, 116 is mounted in the first position A such that it can be displaced between the inserted position I and the pulled-out position II.

Figure 2:
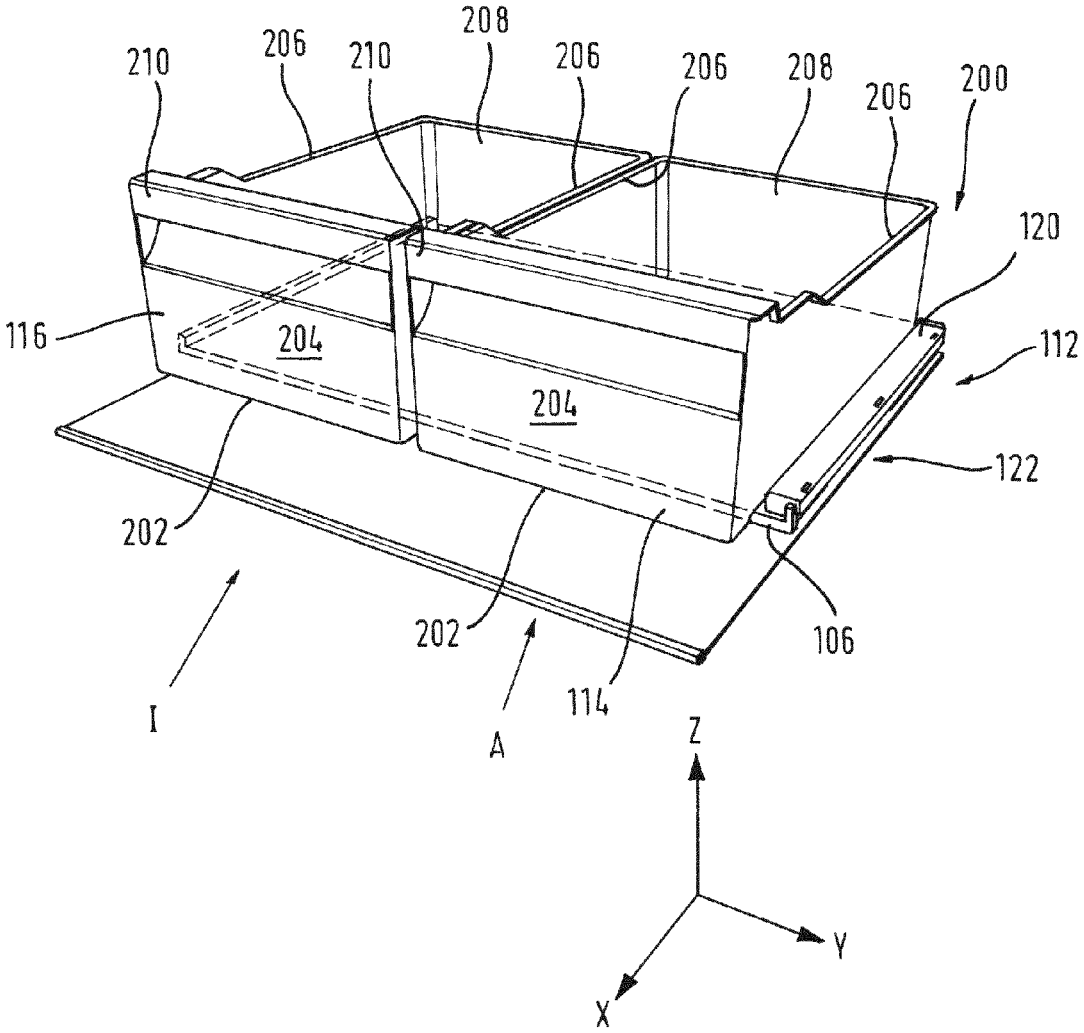
FIG. 2 shows a perspective view of a drawer.
Figure 3:
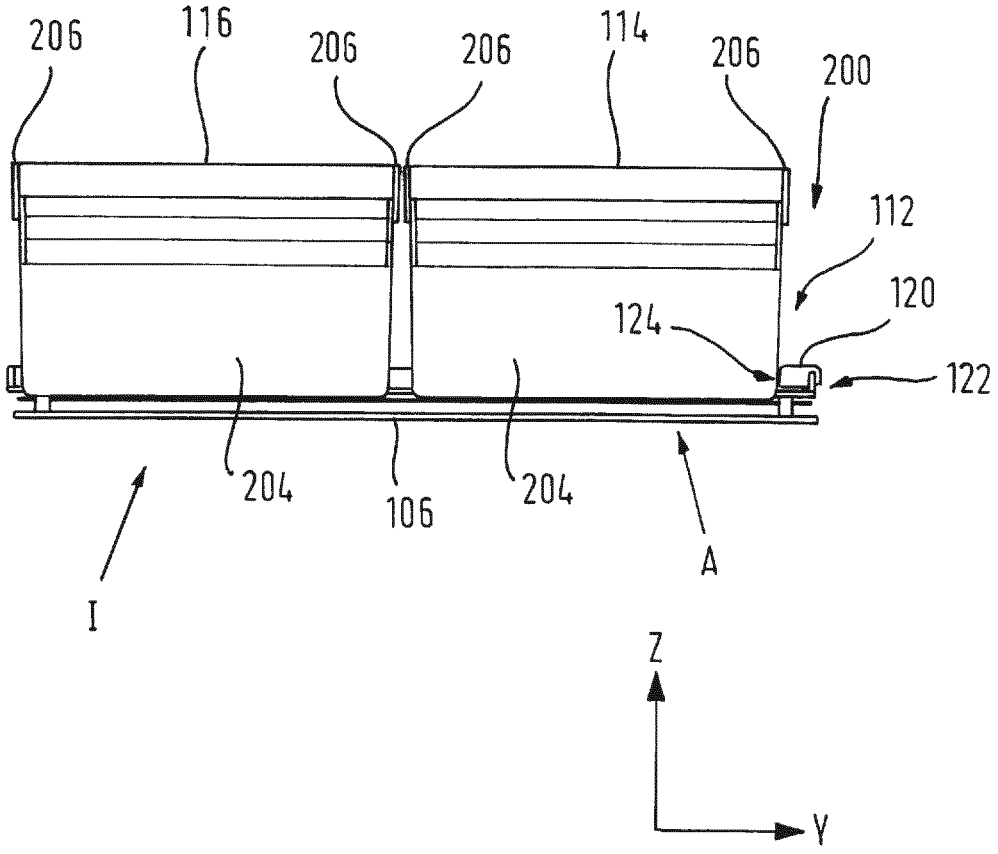
FIG. 3 shows a plan view of the drawer in the first position and a perspective view of a drawer.

FIGS. 2 and 3 show that to this end the spacer 120 is arranged at a first point 200 to the right of the storage compartment 114. Thus in the present exemplary embodiment, the first position A is assigned to the first point 200.

In particular, FIG. 2 shows that in the present exemplary embodiment each storage compartment 114, 116 has a base 202, a front wall 204, two respective side walls 206 as well as a rear wall 208. In the present exemplary embodiment, both storage compartments 114, 116 are produced in one piece from plastics material. In order to facilitate the displacement from the inserted position I into the pulled-out position II and vice versa, both storage compartments 114, 116 have in the present exemplary embodiment an integrally formed handle 210.

With reference to FIG. 3 it may be seen that the contact surface 124 of the spacer 120 is in contact with a portion of the right-hand side wall 206 of the storage compartment 114, in order to fix the storage compartment 114 in the first position A.

Figure 4:
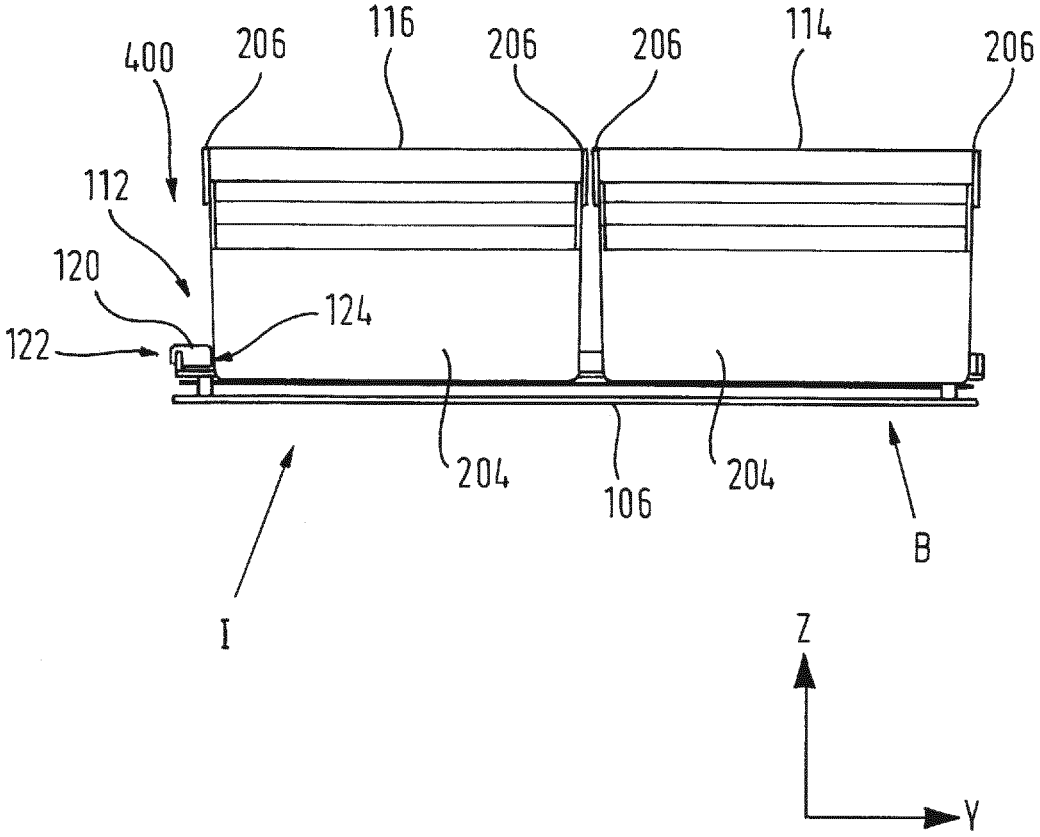
FIG. 4 shows a plan view of the drawer in a second position.

Whilst in FIGS. 2 and 3 the spacer 120 is arranged to the right of the storage compartment 114, FIG. 4 shows that the spacer 120 is arranged to the left of the other storage compartment 116. Thus, the spacer 120 at the first point 200 fixes the first position A and at a second point 400 fixes the second position B, in which the storage compartments 114, 116 are able to be displaced from the inserted position I into the pulled-out position II and vice versa.

In this case, the spacer 120 ensures both at the first point 200 and at the second point 400, that the storage compartment 114, 116 has sufficient spacing 112 from the collision edge 108 of the refrigeration appliance door 102, if the refrigeration appliance door 102 has an opening angle $\alpha$ 90°. Thus by changing the spacer 120 from the first point 200 to the second point 400 and vice versa, it is possible to change from the first position A to the second position B of the storage compartments 114, 116 on the pull-out panel 106 and vice versa. Therefore, the storage compartments 114, 116 on the pull-out panel 106 no longer have to have sufficient spacing from the collision edge 108 on both sides, but on one side this space may be used for enlarging the volume of the storage compartments 114, 116, so that as a whole the volume for the refrigerated goods is increased.

Figure 5:
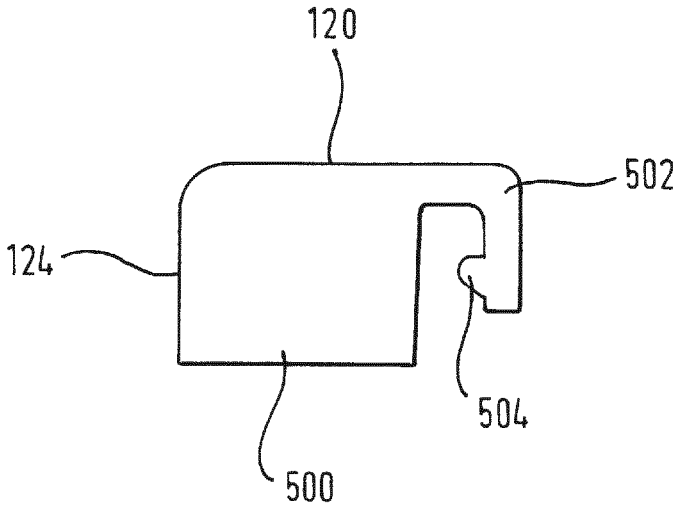
FIG. 5 shows a schematic view of a spacer.

FIG. 5 shows the spacer 120.

In the present exemplary embodiment, the spacer 120 has a base body 500 which forms the contact surface 124.

Moreover, in the present exemplary embodiment the spacer 120 has a latching hook 502 for forming the latching connection 122.

The latching hook 502 in the present exemplary embodiment is integrally formed on the base body 500. Thus in the present exemplary embodiment the base body 500 is integrally formed in the same material with the latching hook 502.

The latching hook 502 also has in the present exemplary embodiment a latching lug 504 which engages in a recess of the pull-out panel 106 in order to secure the latching connection 122. In this case in the present exemplary embodiment, the latching hook 502 is configured to be resiliently deformable, so that when applying minimal force the latching hook 502 is deformed and thus the latching lug 504 comes out of engagement. Thus the spacer 120 may be released from the pull-out panel 106 without the use of tools and fastened at a different point 200, 400 in order to implement an adaptation when changing the door stop.

Instead of a spacer 120 which optionally may be arranged at a first point 200 and at a second point 400, a spacer which has a first portion and a second portion which are connected together in an articulated manner, for example, by means of a film hinge, may also be provided. By a pivoting movement, for example, this spacer may be moved from a first state in which it fixes the first position A for the storage compartments 114, 116 into a second state in which it fixes the second position B for the storage compartments 114, 116. Thus it is possible to change between the first position A and the second position B by changing the state of the spacer. This spacer may be fixedly or even releasably arranged on the pull-out panel 106.

Alternatively, a compartment holder may be provided, storage compartments 114, 116 being able to be arranged by means of said compartment holder at two different points on the pull-out panel 106. The first point in this case is assigned to the first position A, whilst the second point is assigned to the second position B. For example, the compartment holder may comprise pins which may be inserted into holes in the pull-out panel 106, wherein a first set of holes is assigned to the first position A and a second set of holes is assigned to the second position B.

LIST OF REFERENCE NUMERALS

100 Refrigeration appliance
102 Refrigeration appliance door
104 Refrigeration compartment
106 Pull-out panel
108 Collision edge
110 Side wall
112 Space
114 Storage compartment
116 Storage compartment
118 Door post
120 Spacer
122 Latching connection
124 Contact surface
200 First point
202 Base
204 Front wall
206 Side wall
208 Rear wall
210 Handle
400 Second side
500 Base body
502 Latching hook
504 Latching lug
I Inserted position
II Pulled-out position
$\alpha$ Door opening angle
A First position
B Second position
X Direction of the depth of the refrigeration appliance
Y Direction of the width of the refrigeration appliance
Z Direction of the height of the refrigeration appliance

The invention claimed is:

1. A refrigeration appliance comprising a refrigeration compartment in which a storage compartment for refrigerated goods is mounted on a pull-out panel such that it can be displaced between an inserted position and a pulled-out position, wherein the storage compartment can be arranged in a first position and in a second position on the pull-out panel, wherein the first position and the second position differ in the direction of the width of the refrigeration appliance, wherein a spacer is able to be arranged at a first point or at a second point on the pull-out panel, wherein with a spacer at the first point the compartment is in the first position and with a spacer at the second point the compartment is in the second position, wherein the spacer is fastened to the pull-out panel, so that a minimal spacing is maintained on one side of the storage compartment.

2. The refrigeration appliance (100) as claimed in claim 1, wherein the spacer has a contact surface for the storage compartment.

3. The refrigeration appliance as claimed in claim 1, wherein the spacer is fastened to the pull-out panel by means of a latching connection.

4. The refrigeration appliance as claimed in claim 2, wherein the spacer has a latching hook for forming the latching connection.

5. The refrigeration appliance as claimed in claim 4, wherein the latching hook has a latching lug.

6. The refrigeration appliance as claimed in claim 2, wherein the latching connection is configured to be releasable without the use of tools.

7. The refrigeration appliance as claimed in claim 1, wherein a spacer is able to be moved into a first state or into a second state, wherein with a spacer in the first state the storage compartment is in the first position and with a spacer in the second state the storage compartment is in the second position.

8. The refrigeration appliance as claimed in claim 7, wherein the spacer has a first portion and a second portion, wherein the first portion and the second portion are connected together in an articulated manner.

9. The refrigeration appliance as claimed in claim 8, wherein the first portion and the second portion of the spacer are connected together in an articulated manner by a film hinge.

10. The refrigeration appliance as claimed in claim 1, wherein the pull-out panel has at least two compartment holders arranged offset in the direction of the width of the refrigeration appliance.

11. The refrigeration appliance as claimed in claim 10, wherein a third compartment holder is provided.

* * * * *